US006099180A

United States Patent [19]

Yang et al.

[11] Patent Number: 6,099,180

[45] Date of Patent: Aug. 8, 2000

[54] METHOD FOR FEEDING PAPER IN IMAGE FORMING APPARATUS

[75] Inventors: Chul-Joo Yang, Daegu; Sung-Guen Park, Kyeonsangbook-do, both of Rep. of Korea

[73] Assignee: SamSung Electronics Co., Ltd., Suwon, Rep. of Korea

[21] Appl. No.: 09/383,149

[22] Filed: Aug. 26, 1999

[30] Foreign Application Priority Data

Aug. 26, 1998 [KR] Rep. of Korea ..... 98-34578

[51] Int. Cl.[7] ..... B41J 13/02

[52] U.S. Cl. ..... 400/624; 101/235; 400/708; 400/634

[58] Field of Search ..... 400/634, 636.1, 400/624, 627, 629, 708; 101/232, 235; 358/437; 271/121, 291

[56] References Cited

U.S. PATENT DOCUMENTS

| | | | |
|---|---|---|---|
| 4,789,259 | 12/1988 | Katayanagi | 400/624 |
| 5,090,318 | 2/1992 | Sugimoto et al. | 400/624 |
| 5,100,120 | 3/1992 | Kikuchi et al. | 400/624 |
| 5,357,329 | 10/1994 | Ariyama et al. | 271/291 |
| 5,480,247 | 1/1996 | Saikawa et al. | 400/629 |
| 5,489,159 | 2/1996 | Abbott et al. | 400/624 |
| 5,499,807 | 3/1996 | Nakamura | 271/121 |
| 5,672,019 | 9/1997 | Hiramatsu et al. | 400/624 |
| 5,725,319 | 3/1998 | Saito et al. | 400/624 |
| 5,732,321 | 3/1998 | Ishizuka et al. | 271/9.06 |
| 5,816,723 | 10/1998 | Takahashi et al. | 400/624 |
| 5,832,190 | 11/1998 | Terijima et al. | 358/437 |
| 5,853,256 | 12/1998 | Kim | 400/624 |

*Primary Examiner*—Eugene Eickholt
*Attorney, Agent, or Firm*—Robert E. Bushnell, Esq.

[57] ABSTRACT

A process and image formation apparatus with an enhanced loading of printable media onto a path of conveyance through the apparatus during the practice of the process by feeding paper for an image forming apparatus by setting a predetermined pickup time of a pickup roller; detecting wether a paper is picked up by the pickup roller when a printing order is received; wherein if the paper is detected, a printing operation is performed, if the paper is not detected, a pickup time of the pickup roller is counted and attempting to pick up the paper by the pickup roller until the counted pickup time is not less than the predetermined pickup time or until the paper is detected.

12 Claims, 2 Drawing Sheets

METHOD FOR FEEDING PAPER IN IMAGE FORMING APPARATUS

CLAIM OF PRIORITY

This application makes reference to, incorporates the same herein, and claims all benefits accruing under 35 U.S.C §119 from an application entitled Method For Feeding Paper In Image Forming Apparatus earlier filed in the Korean Industrial Property Office on Aug. 26, 1998, and there duly assigned Serial No. 98-34578 by that Office.

BACKGROUND OF THE INVENTION

1. Field of the Invention

The present invention generally relates to a process and image formation apparatus for feeding paper during the formation of images upon printable media, and, more particularly, to a a process and apparatus that endeavors to minimize errors and interruption of image formation by controlling a pickup roller in an effort to continue to attempt to pick up the printable media when the pickup roller fails to pickup the printable media to be printed.

2. Description of the Related Art

Generally, image formation equipment such as a facsimile apparatus, a copier, a printer or a MFP (e.g., a multi-function peripheral) are products which are commonly manufactured to have a printing function. These machines are equipped with an image forming apparatus, and usually, a paper cassette to load printable media such as individual cut sheets of paper. The paper loaded in the paper cassette is picked up and transmitted to a printer, and an image is printed onto one or both major surfaces of the paper with a dye such as a toner, and the paper is discharged from the apparatus.

Meanwhile, a paper jam sometimes occurs when printing the images on the paper. We have found that there are several reasons why the paper jam may have occurred. First, there is slippage of a pickup roller due to a difference of friction coefficients between the paper and the pickup roller. Therefore, the paper is not fed properly and a printing operation is not successfully performed. At this time, it is called a "Jam 0" or "feeding error".

Second, although the paper has been normally picked up, sometimes the apparatus fails to execute the feeding operation properly, a situation that is called a "Jam 1" or "transmission error". Third, when the printing operation is performed normally, but the operation of discharging the paper by conveying the paper through the apparatus and depositing the printed sheet of paper on a tray outside the apparatus is improperly executed, the occurrend is called a "Jam 2" or "discharging error".

As described above, when the paper jam occurs, the operation of the image forming apparatus must assume a standstill mode while waiting for the operator who is using the apparatus to correct the paper jam. In this state, since no keys on an operation panel can be operated by the user, the user has to first confirm the location of the paper jam, and the remove the jam, usually by removing the sheet of paper. We have also noticed that if a paper jam occurs in the image forming apparatus even though the paper has been properly loaded in the paper cassette, the paper will not be picked up, and all printing operations will be suspended until the user removes source of the error.

SUMMARY OF THE INVENTION

It is therefore an object of the present invention to provide an improved process and image formation apparatus for feeding printable media into the apparatus during the formation of images upon the printable media.

It is another object to provide a process and image formation apparatus with an enhanced ability to continue printing operations despite an initial failure of the apparatus to load printable media onto a path of conveyance through the apparatus.

It is still another object to provide a process and image formation apparatus that endeavors to minimize errors and interruption of image formation by controlling a pickup roller in an effort to continue to attempt to pick up the printable media after the pickup roller has initially failed to pickup the printable media.

It is yet another object to provide a process and image formation apparatus that endeavors to minimize interruption of image formation by continuing to move printable media into a path of conveyance through the apparatus even after the pickup roller has initially failed to load the printable media onto the path.

It is still yet another object to provide a process and image formation apparatus for feeding paper in an image forming apparatus in which a pickup roller is driven, until a fed sheet of paper is detected, a predetermined number of turns corresponding to a predetermined pickup time so that the paper may be picked up or an error message is displayed, when a paper feed error corresponds to a Jam 0, thereby reducing errors and minimizing a recovery operation of the image forming apparatus.

These and other objects may be achieved according to the principles of the present invention with an image formation process and apparatus for feeding paper onto a path of conveyance through the image forming apparatus, by the expedient of setting a predetermined pickup time for a pickup roller; detecting whether a sheet of paper has been picked up by the pickup roller and loaded onto the path of conveyance when a printing order is received; and if the sheet of paper is detected on the path of conveyance, a printing operation is performed by formation of images onto the sheet of paper during the conveyance of the sheet of paper through the apparatus. If a sheet of paper is not detected however, a pickup time for the pickup roller is counted and the pickup roller is driven until the loading of a sheet of paper is sensed or until the count of the pickup time is greater than or equal to the predetermined pickup time.

The step of setting the predetermined pickup time of the pickup roller may be implemented by selecting a key on the operation panel, that sets the pickup time for continuing the rotation of the pickup roller; inputting the pickup time for the pickup roller; and storing this pickup time in a memory that is used to store a routine for controlling the apparatus.

The step of setting the predetermined pickup time of the pickup roller may alternatively be implemented by inputting the pickup time for continuing the rotation of the pickup roller through a software program; transferring the pickup time for the pickup roller along with a printing data; and storing this pickup time in a memory.

Feeding printable media such as individual cut sheets of paper onto the path of conveyance through the image forming apparatus may be practiced by detecting the paper loading state in a paper cassette that has been inserted into the apparatus, and if a determination is made that the paper loading state has changed (e.g., after the cassette has been removed and then re-inserted into the apparatus), the count of the pickup time is initialized and the counting operation of the pickup time restarted from the initialized state.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
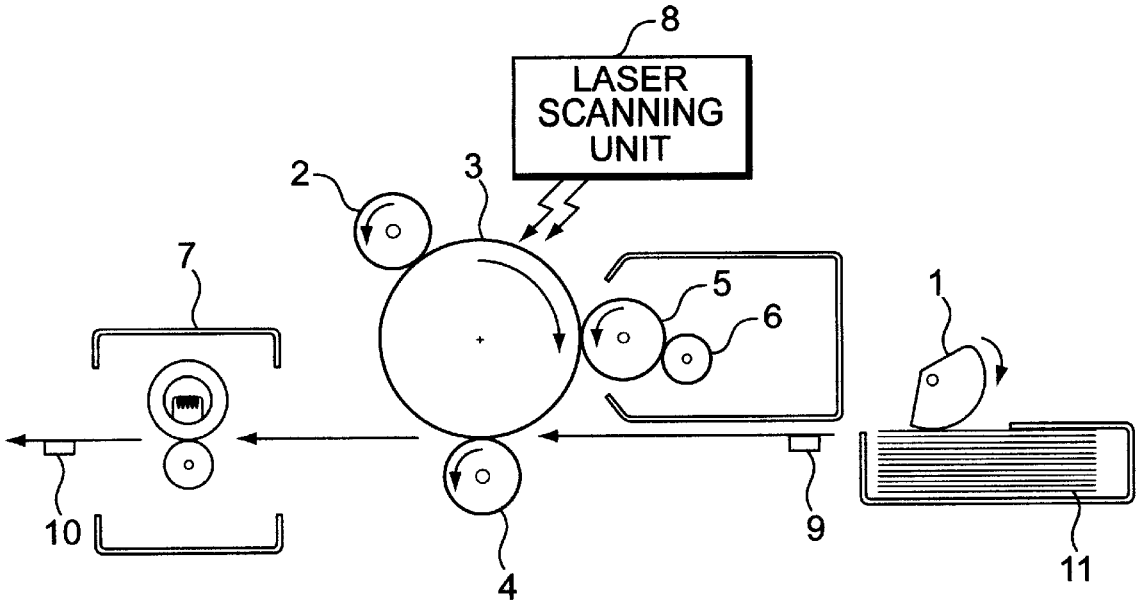
FIG. 1 is a schematic view showing a moving route of individual sheets of a printable media along a path of conveyance through an image forming apparatus during the practice of the present invention.

The present invention now will be described more fully hereinafter with reference to the accompanying drawings, in which preferred embodiments of the invention are shown. Turning now to the drawings, FIG. 1 illustrates that, in order to print an image corresponding to data carried by a signal applied to the apparatus onto one surface of a cut sheet of paper, the image forming apparatus may be constructed with a pickup roller 1, a charging roller 2, a photosensitive drum 3, a transfer roller 4, a developing roller 5, a feed roller 6, a fixing device 7, a laser scanning unit 8 and sensors 9, 10. During operation of the image forming apparatus, the charging roller 2, charged by a high voltage, is rotated and charges a photosensitive material on an outer surface of the photosensitive drum 3. The laser scanning unit 8 generates a laser beam and forms an electrostatic latent image on the surface of the charged photosensitive drum 3. After that, the toner which is supplied from the feed roller 6 to the developing roller 5 is coated on the electrostatic latent image on the surface of the charged photosensitive drum 3 so as to form a visible image. The transfer roller 4 transfers the visible image on the surface of the charged photosensitive drum 3 to the paper 11. The visible image which is transferred to the paper 11 is fixed by a high temperature and a high pressure of the fixing device 7 and the printing process is ended.

The image forming apparatus may be fitted with a resistor sensor 9 positioned along the path of conveyance of the printable media in order to detect a paper jam during the printing process, and ejection sensor 10 that is also located along the path of conveyance, albeit downstream from sensor 9. Resistor sensor 9 is disposed between the pickup roller 1 and a developing device while ejection sensor 10 is disposed between the fixing device 7 and ejection roller (not shown).

Figure 2:
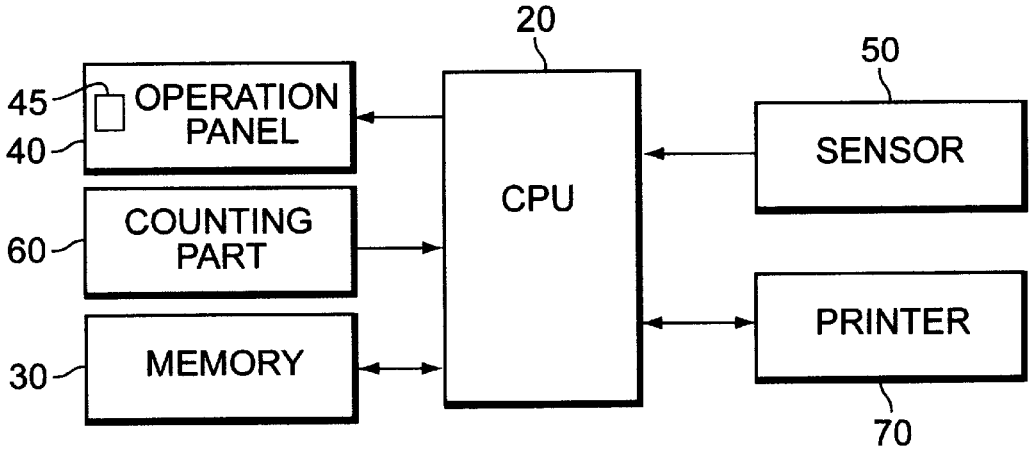
FIG. 2 is a schematic block diagram showing one construction of the image forming apparatus in FIG. 1.

In FIG. 2, a central processing unit (CPU) 20 entirely controls the image forming apparatus. particularly, if a sensor part 50 senses a fact that the paper 11 is not picked up, the CPU 20 drives the pickup roller 1 so that the paper 11 is picked up. A memory 30 stores an operation program of the CPU 20, a general controlling program and data generated by the operation program of the CPU 20. Particularly, the memory 30 stores a pickup time of the pickup roller 1.

The image formation apparatus may be equipped with an operational panel 40 is provided with a plurality of manually operable keys (not shown) that generate key data for the system, and particularly, that may be used by the operator to set the pickup time of the pickup roller 1. The operation panel 40 is further provided with a display part 45 which displays information which is input to the CPU 20 and displays data output from the CPU 20.

The sensor part 50 may be constructed with resistor sensor 9 for detecting the paper jam, the ejection sensor 10, a sensor (not shown) for detecting whether paper is loaded in a paper cassette and a sensor (not shown) for detecting whether the paper cassette is loaded in the image forming apparatus. A counting part 60 counts the pickup times, i.e., number of turns, of the pickup roller 1 and inputs the pickup times to the CPU 20. A printer 70 prints data which is controlled by the CPU 20 and is stored in the memory 30.

Figure 3:
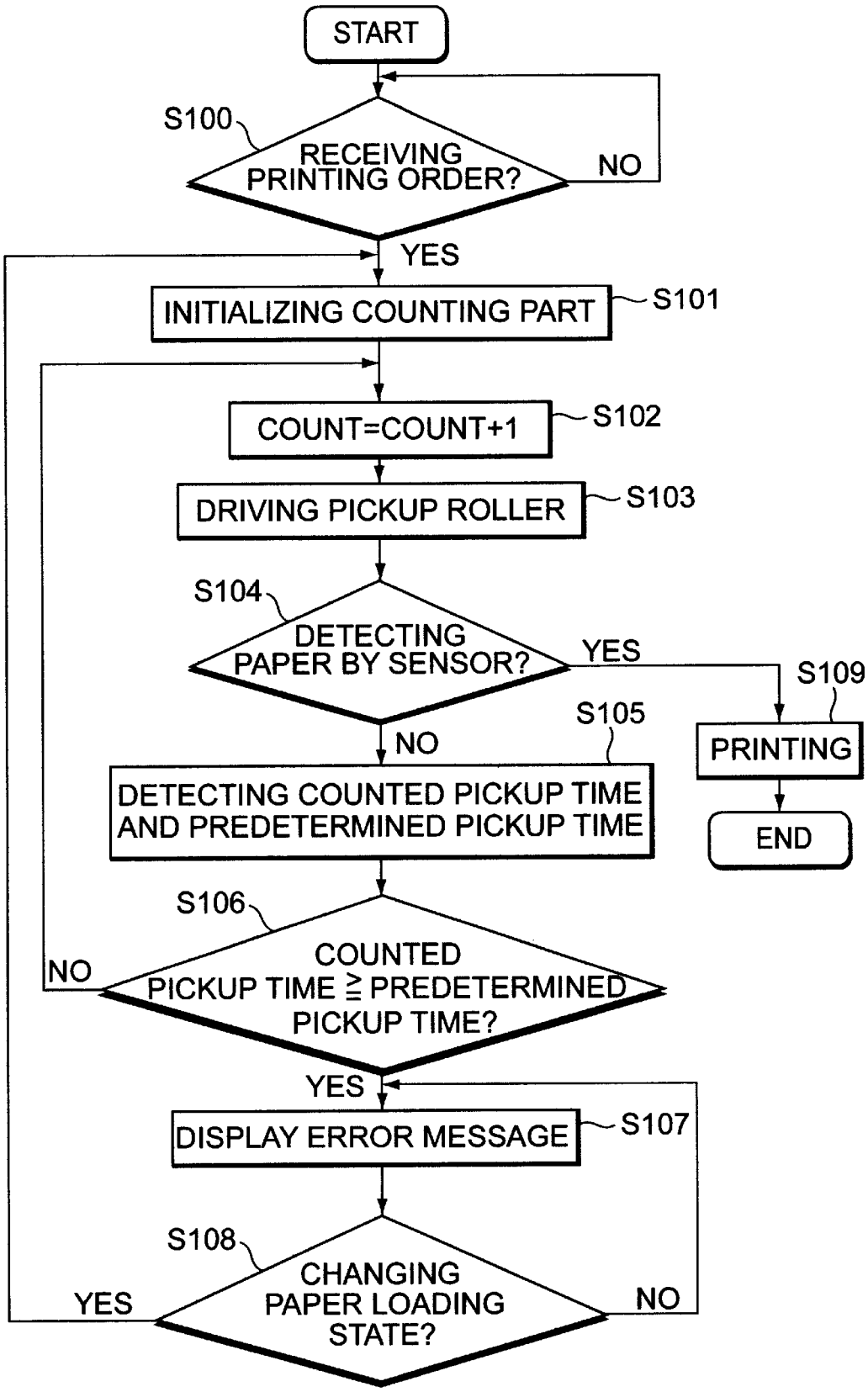
FIG. 3 is a flow chart showing a feeding process for the image forming apparatus according to the principles of the present invention.

Referring now to FIG. 3 of the appended drawings, feeding of successive cut sheets of printable media such as paper or transparencies, according to the principles of the present invention will be described fully. First of all, if a printing order is received (S100), the CPU 20 applies a driving power to each roller 2, 4, 5, 6 of the image forming apparatus and drives the rollers 2, 4, 5, 6. The counting part 60 for counting the pickup times of the pickup roller 1 is initialized (S101). Then, in the counting part 60, a counting value is increased as much as one at a time by a control operation of the CPU 20 (S102) for controlling the pickup roller makes one revolution, and the pickup roller 1 is driven to pick up the paper 11 (S103). After the driving of the pickup roller 1, sensor 9 is checked to determine whether the paper 11 was picked up and fed by pickup roller 1(S104). At this time, if the paper 11 is not detected by the sensor 9 it means that the pickup roller 1 did not pick up the paper 11. If the paper 11 is detected by the sensor 9, the image forming apparatus performs a normal operation so as to print the data on the paper 11 (S109), and then the printing process is ended.

Meanwhile, if the paper 11 is not detected by the sensor 9 in step S104, the CPU 20 detects the counted pickup time counted by the counting part 60 and the predetermined pickup time of the pickup roller 1 stored in memory 30(S105). Here, one method of setting the pickup time of the pickup roller 1 in memory 30 is as follows: 1) a key of the plurality of keys on the operation panel 40 which sets the pickup time of the pickup roller 1 is selected, and then a user inputs the pickup time and stores the pickup time in the memory; or 2) a host computer sets the pickup time of the pickup roller 1 while outputting the printing order, and transfers the pickup time of the pickup roller 1 with the data to be printed. Next, it is determined whether the counted pickup time of the pickup roller 1 counted by the counting part 60 is less than the predetermined pickup time (S106). If the counted pickup time counted by the counting part 60 is less than the predetermined pickup time, the process returns to the step 102 so that the count value is increased by one by a control operation of the CPU 20.

Meanwhile, if the counted pickup time counted by the counting part 60 is not less than the predetermined pickup time, an error massage is displayed on the display part 45 of the operation panel 40 (S107). After the step S107, if it is detected by a sensor that a paper loading state in the paper cassette is changed, the process returns to step S101 which initializes the counting part 60. If the paper loading state in the paper cassette is not changed, the error massage is continuously displayed on the display part 45 of the operation panel 40. That is, if the user takes the paper cassette out and then puts the paper cassette in, the sensor for detecting the paper loading state detects this movement of the paper cassette and inputs this information to the CPU 20. Since the movement of the paper cassette means that the user performs an action for removing an error, the CPU 20 initializes the counting part 60 and drives the pickup roller 1 to again attempt to pickup paper 11.

Described as above, in the method for feeding paper in an image forming apparatus according to the present invention, if the paper is not picked up by the pickup roller 1, the pickup operation is performed as many times as a predetermined, thereby minimizing the generation of errors.

This invention has been described above with reference to the aforementioned embodiments. It is evident, however, that many alternative modifications and variations will be apparent to those having skill in the art in light of the foregoing description. Accordingly, the present invention embraces all such alternative modifications and variations as fall within the spirit and scope of the appended claims.

What is claimed is:

1. A process for feeding paper for an image forming apparatus, comprising steps of:

setting a predetermined pickup time of a pickup roller;

increasing a count value by one and driving said pickup roller one revolution;

detecting whether a paper is picked up by the pickup roller;

performing a printing operation when the paper is detected;

comparing said count value to said predetermined pickup time, when the paper is not detected;

returning to said step of increasing the count value by one when said count value is less than said predetermined pickup time; and displaying an error message when said count value is not less than said predetermined pickup time.

2. The process of claim 1, wherein the step of setting the predetermined pickup time of the pickup roller comprises the steps of:

selecting a key on an operation panel, which sets the pickup time of the pickup roller;

inputting the pickup time of the pickup roller; and storing the input pickup time in a memory as said predetermined pickup time.

3. The process of claim 1, wherein the step of setting the predetermined pickup time of the pickup roller comprises the steps of:

inputting the pickup time of the pickup roller through a software program;

transferring the pickup time of the pickup roller along with printing data; and storing the pickup time of the pickup roller in a memory as said predetermined pickup time.

4. The process of claim 1, further comprising steps of:

detecting a paper loading state of a paper cassette;

initializing a counter to initialize said count value, when it is determined that the paper loading state has changed; and returning to said step of displaying, when it is determined that the paper loading state has not changed.

5. The process of claim 2, further comprising steps of:

periodically detecting a paper loading state of a paper cassette by sensing whether the cassette is inserted into the apparatus;

making a determination of whether said loading state has changed;

initializing a counter to initialize said count value, when said determination establishes that said paper loading state has changed; and returning to said step of displaying, when it is determined that the paper loading state has not changed.

6. The process of claim 3, further comprising steps of:

periodically detecting a paper loading state of a paper cassette by sensing whether the cassette is inserted into the apparatus;

making a determination of whether said loading state has changed;

initializing a counter to initialize said count value, when said determination establishes that said paper loading state has changed; and returning to said step of displaying, when it is determined that the paper loading state has not changed.

7. A process for feeding paper for an image forming apparatus, comprising steps of:

responding to reception of data corresponding to a print order indicating a formation of images onto a printable media, by setting a pickup time for driving a pickup roller to rotate while said pickup roller is extracting a cut sheet of a printable media from a cassette inserted into said apparatus;

changing a count value by one and driving said pickup roller by one revolution;

detecting whether a sheet of the printable media has been extracted from the cassette by said pick-up roller and loaded onto an entrance of a path of conveyance through the apparatus;

performing a printing operation by forming said images on one surface of the printable media when the printable media is detected on said path of conveyance;

comparing said count value to said pickup time, when no sheet of printable media is detected on said entrance;

returning to said step of changing said count value by one when said count value is less than said predetermined pickup time; and displaying an error message when said count value is not less than said pickup time.

8. The process of claim 7, wherein the step of setting the predetermined pickup time of the pickup roller comprises the steps of:

selecting a key on an operation panel, which sets the pickup time of the pickup roller;

inputting the pickup time of the pickup roller; and storing the input pickup time in a memory as said predetermined pickup time.

9. The process of claim 7, wherein the step of setting the predetermined pickup time of the pickup roller comprises the steps of:

inputting the pickup time of the pickup roller through a software program;

transferring the pickup time of the pickup roller along with printing data; and storing the pickup time of the pickup roller in a memory as said predetermined pickup time.

10. The process of claim 7, further comprising steps of:

detecting a paper loading state of said cassette;

initializing a counter to initialize said count value, when it is determined that the paper loading state has changed due to removal and re-insertion of said cassette into said apparatus; and returning to said step of displaying, when it is determined that the paper loading state has not changed.

11. The process of claim 8, further comprising steps of:

periodically detecting a paper loading state of said cassette by sensing whether said cassette is inserted into the apparatus;

making a determination of whether said loading state has changed;

initializing a counter to initialize said count value, when said determination establishes that said paper loading state has changed; and returning to said step of displaying, when it is determined that the paper loading state has not changed.

12. The process of claim 9, further comprising steps of:

periodically detecting a paper loading state of said cassette by sensing whether said cassette is inserted into the apparatus;

making a determination of whether said loading state has changed;

initializing a counter to initialize said count value, when said determination establishes that said paper loading state has changed; and returning to said step of displaying, when it is determined that the paper loading state has not changed.

* * * * *